United States Patent [19]

Kowatsch et al.

[11] Patent Number: 4,989,893

[45] Date of Patent: Feb. 5, 1991

[54] TOE UNIT FOR A SAFETY SKI BINDING

[75] Inventors: Ulrich Kowatsch, Leonberg; Martin Bogner, Ostfildern; Otto Harsányi, Leonberg, all of Fed. Rep. of Germany

[73] Assignee: GEZE Sport International GmbH, Leonberg, Fed. Rep. of Germany

[21] Appl. No.: 284,147

[22] Filed: Dec. 14, 1988

[30] Foreign Application Priority Data

Dec. 15, 1987 [DE] Fed. Rep. of Germany ..... 3742483

[51] Int. Cl.[5] ..... A63C 9/00

[52] U.S. Cl. ..... 280/625; 280/611; 280/623

[58] Field of Search ..... 280/625, 628, 629, 630, 280/631, 632, 633, 636, 618, 611, 607, 615, 809, 623, 811; 36/120, 121

[56] References Cited

U.S. PATENT DOCUMENTS

| | | | |
|---|---|---|---|
| 3,690,690 | 9/1972 | Marker | 280/611 |
| 3,825,273 | 7/1974 | Greene | 280/618 |
| 3,917,298 | 11/1975 | Haff | 280/607 |
| 4,307,895 | 12/1981 | Storandt et al. | 280/632 |
| 4,593,928 | 6/1986 | Scheck | 280/625 |

FOREIGN PATENT DOCUMENTS

| | | | |
|---|---|---|---|
| 1578974 | 5/1972 | Fed. Rep. of Germany . | |
| 2161881 | 6/1972 | Fed. Rep. of Germany . | |
| 2165314 | 7/1973 | Fed. Rep. of Germany . | |
| 2442718 | 7/1975 | Fed. Rep. of Germany | 280/631 |
| 2707926 | 8/1978 | Fed. Rep. of Germany . | |

*Primary Examiner*—David M. Mitchell

*Attorney, Agent, or Firm*—Townsend and Townsend

[57] ABSTRACT

A toe unit of a ski safety binding has a housing (15) which is fixedly mountable on a ski, a release spring (14) and sole clamp arms (18) which are pivotable outwardly to the side relative to the housing against spring force and which locate the tip of an inserted ski boot in the sideways direction on the ski (40), but pivot sideways outwardly against the spring force and release the ski boot on the occurrence of sideways forces which lie above a predetermined release value. The space for movement (11) between the housing (15) and the outwardly pivotable sole clamp arms (18) is filled out, at least in the regions which border on the outside atmosphere, and preferably radially outside of the associated pivot axis (13), by an elastic filling piece (12). The elasticity of the filling piece (11) is restricted so that the elastic resetting force at the sole clamp arm (18) generated through compression of the filling piece (12) in the release position of the ski boot only amounts to a fraction of the resetting force generated by the release spring (14).

2 Claims, 5 Drawing Sheets

TOE UNIT FOR A SAFETY SKI BINDING

Figure 1:
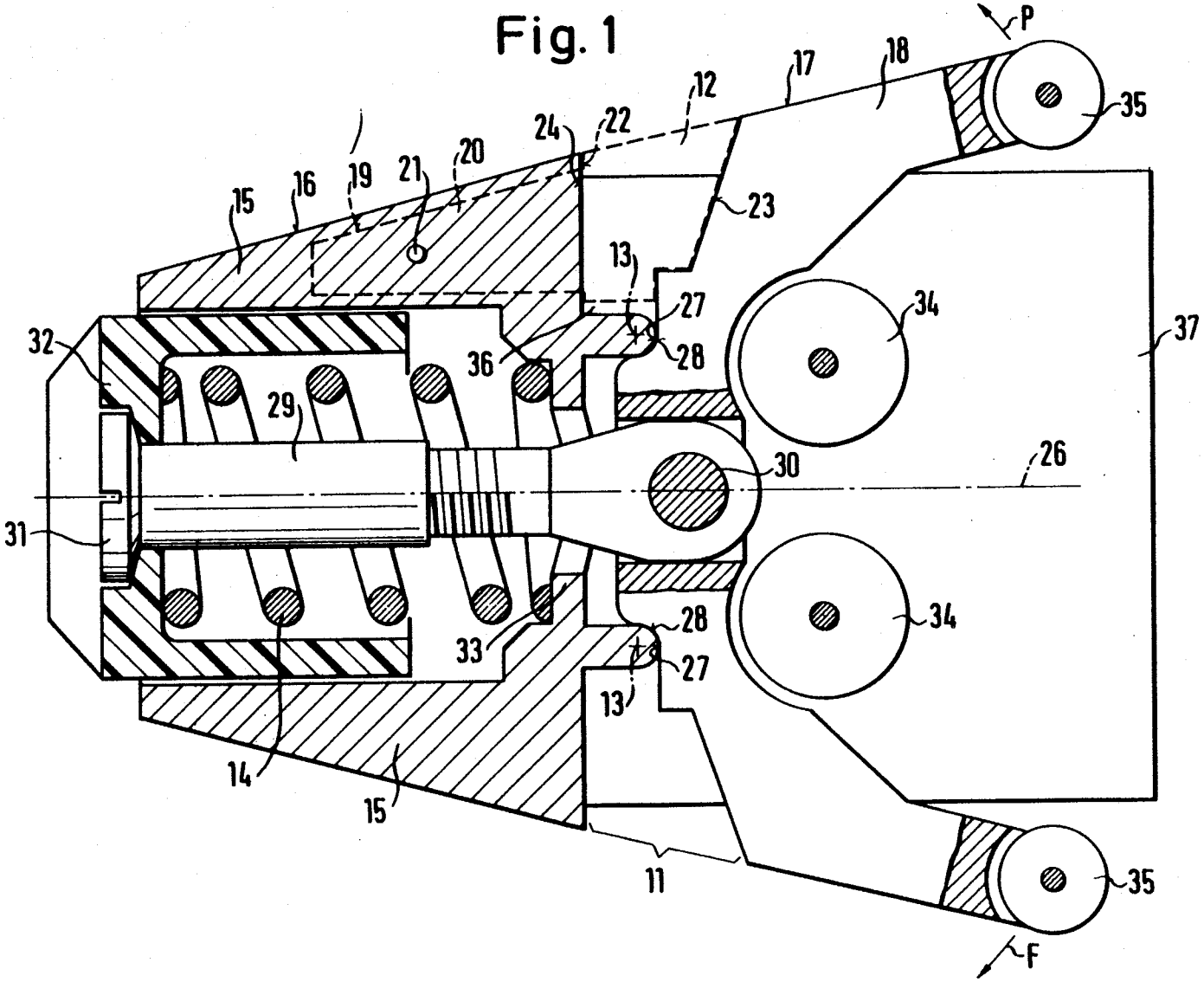

The present invention relates to a toe unit for a safety ski binding comprising a housing fixable to a ski, a release spring and sole clamp arms which are pivotable outwardly to the side relative to the housing against spring force and which locate the tip of an inserted ski boot in the sideways direction on the ski, but pivot sideways outwardly against the spring force and release the ski boot on the occurrence of sideways forces which lie above a predetermined release value, wherein space for movement is provided at the sides between the housing and the outwardly pivotable sole clamp arms.

In toe units of this kind the sole clamp arms preferably form a so-called tilt jaw (German Offenlegungsschrift 37 34 492 or German Offenlegungsschrift 37 42 391), i.e. the sole clamp arms which are pivotable outwardly to the side are resiliently supported at the binding housing via tilting surfaces provided on both sides of the central longitudinal axis and are outwardly pivotable to the right or to the left about tilting axes which are provided in the region of the tilting surfaces and are substantially vertical. The tilt jaws can be made in one piece, in which case, the two sole clamp arms are rigidly connected together. It is however also possible to make the tilt jaws in two pieces by hingedly connecting each sole clamp arm with the end of a draw rod which is for example spring loaded. Toe units of the same species as the invention also include toe units in which sole clamp arms are provided which are fixedly hinged to the binding housing and are for example held in their normal position by a spring loaded yoke, see for example German Offenlegungsschrift 33 37 993.

In such toe units the problem exists that space for movement must be provided between the laterally outwardly pivotable sole clamp arms and that this space can fill with contamination, snow or ice, whereby the problemfree functioning of the binding is impaired. Furthermore, the projections corners and edges which are brought about by the space for movement prove disadvantageous when using the binding, apart from the deleterious effect on the external appearance of such a toe unit. The irregular outer shape of such toe units can result in the skier becoming caught up on objects or on people for example during skiing or when transporting the ski.

The object of the invention is to provide a toe unit of the initially named kind which, despite the fact that it comprises a housing fixedly mounted to the ski and laterally outwardly pivotable sole clamp arms, gives the impression from the outside of being a unitary construction and in particular has an outer surface which is largely free of steps, corners and edges in the region between the binding housing and the sole clamp arms, so that contamination, snow and ice cannot penetrate via the space for movement into the movable mechanism of the toe unit, so that the danger of being caught up on articles or persons due to an irregular outer surface in the region between the housing and the sole clamp arms is substantially reduced, and so that the cleaning and maintenance of the binding in the clean state is substantially easier, and so that the release and resetting behaviour is also improved.

In order to satisfy this object the present invention provides that in the normal state the space for movement is filled out, at least in the regions which border on the outside atmosphere, and preferably radially outside of the associated pivot axis, by an elastic filling piece the elasticity of which is restricted so that the elastic resetting force at the sole clamp arm generated through compression of the filling piece in the released position of the ski boot only amounts to a fraction of the resetting force generated by the release spring.

Thus, in accordance with the invention, the filling piece fills out the intermediate space between the binding housing and the sole clamp arms in such a way that the binding housing merges uniformly into the sole clamp arms without any large steps, corners and edges, and in particular in a substantially streamlined manner. Moreover the filling piece also contributes as a result of its elastic construction to the release and resetting behaviour of the binding, however only in accordance with fraction of the resetting force generated by the release spring, so that the release behaviour of the toe unit is predominantly determined by the release spring. The fact that the filling piece is effective radially outside of the associated pivot axis, and thus the side of the pivot axis which faces away from the release spring, results in the pivot axis being releived from the resilient forces to a certain degree, and the resetting of the sole clamp arms into the normal position is made favourable by the resilient resetting force delivered by the filling piece. Furthermore, the filling piece exerts a damping effect when the sole clamp arms return rapidly to their normal position and this reduces the wear of the cooperating parts of the toe unit.

The contribution of the filling piece to the release behaviour of the toe unit is preferably such that the saidfraction is any event smaller than 25%, preferably smaller than 20% and in particular smaller than 15%. Moreover, the fraction should preferably amount to 15% to 20% of the lowest resetting force generated by the release spring.

A particularly prefered embodiment is characterized in that in the normal state of the toe unit, the filling piece is flush with the outer surface of the housing and/or the outer surface of the sole clamp arm, at least at the outside at the side and/or at the top. This ensures that the binding housing merges smoothly into the sole clamp arms via the filling piece.

The space for movement in the longitudinal direction of the ski preferably has an extent such that the filling piece is compressed in the ski boot release position relative to the normal position by at most 50%, in particular by 30% to 40% and preferably by 35% of its original volume.

This avoids the resetting force increasing too strongly on compression of the filling piece.

A particularly uniform contribution of the filling piece to the resetting force is achieved in a particularly advantageous manner by an embodiment in which the space for movement, and the filling piece fitted therein, have a substantially uniform thickness in the longitudinal direction of the ski.

The filling piece is furthermore advantageously secured to the housing. This can take place in that the housing has a blind hollow chamber which extends substantially in the longitudinal direction of the ski relative to the filling piece, with a mounting projection arranged on the filling piece and preferably in one piece therewith engaging into the blind hollow chamber, where it is preferably releasably secured to the housing, for example by a transverse pin or by a latching arrangement. A releasable mounting of this kind is preferred in order to be able to interchange damaged filling pieces at any time and also in order to achieve different release forces by means of filling pieces of different hardness.

The mounting projection preferably has a substantially smaller cross-section than the filling piece and merges into the filling piece via a step which is provided at least at the outer side of the filling piece at the top and at the bottom which ensures that only the filling piece and not also the mounting projection participate in the elastic resetting of the sole clamp arm.

A particularly economical and simple layout of the toe unit is characterized in that the release force of the release spring is not adjustable and that instead a set of similarly shaped filling pieces with different elasticity is provided which are expediently characterized by different colouring. Here the measures which are normally required for a release spring of adjustable bias, which are complicated from a technical manufacturing view point are avoided. The adaption to the ideal release force for an individual skier can be executed by suitable coloured filling pieces of different hardness.

A further advantageous embodiment of the invention is characterized in that the oppositely disposed support surfaces of the filling piece on the sole clamp arm and on the housing respectively extend in the normal state of the toe unit parallel to one another and approximately perpendicular to the direction of movement of the support surface of the sole clamp arm at the start of outward pivotal movement.

The spring characteristics of the filling piece can be effectively influenced by an arrangement in which ribs which preferably extend substantially parallel to the support surfaces are provided on the filling piece at the side and/or at the top. The ribs can be of the same width, can be equispaced and preferably have the same width and spacing. The ribs can project outwardly beyond the outer surfaces of the housing and of the sole clamp arms or can be flush with the latter.

In one embodiment the filling piece is inserted with a small prestress in the normal state of the toe unit between the support surfaces of the sole clamp arm and of the housing. This ensures that a larger area gap free contact of the filling piece is achieved at the adjacent support surfaces. Furthermore, this construction ensures a particularly good damping action of the filling piece during the movement of the sole clamp arms from the boot release position into the normal position following a release procedure.

Figure 2:
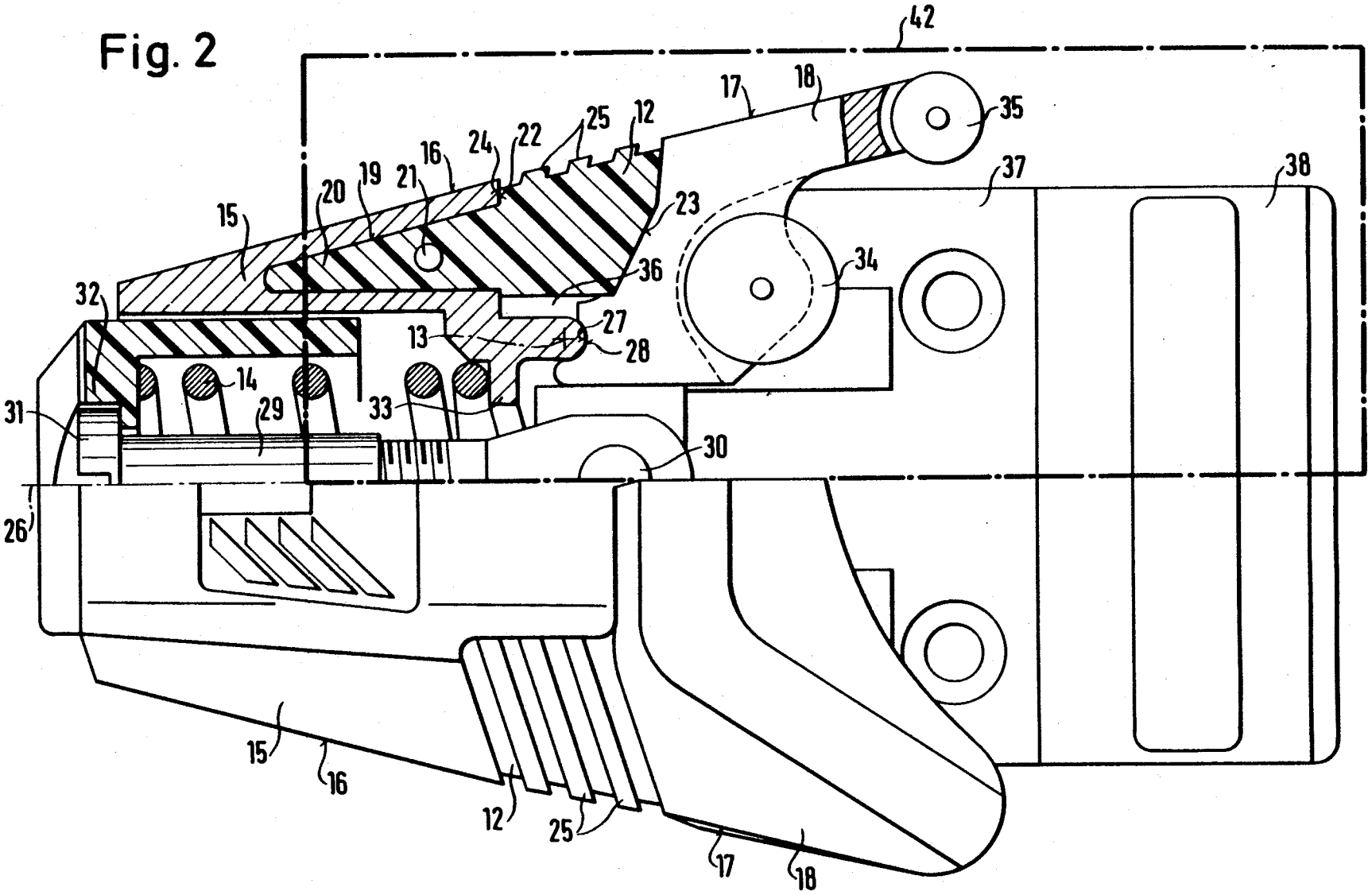
Figure 3:
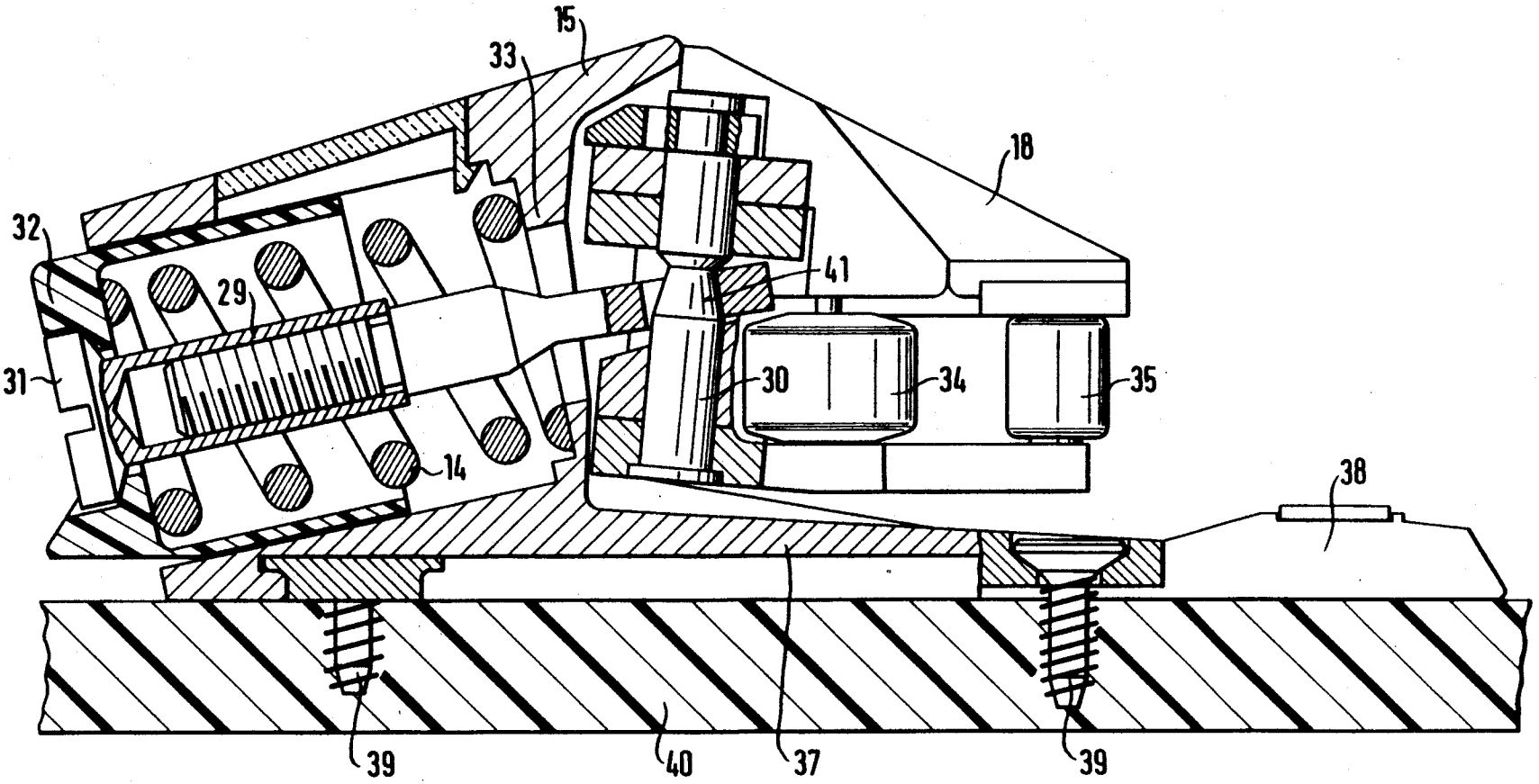
Figure 4:
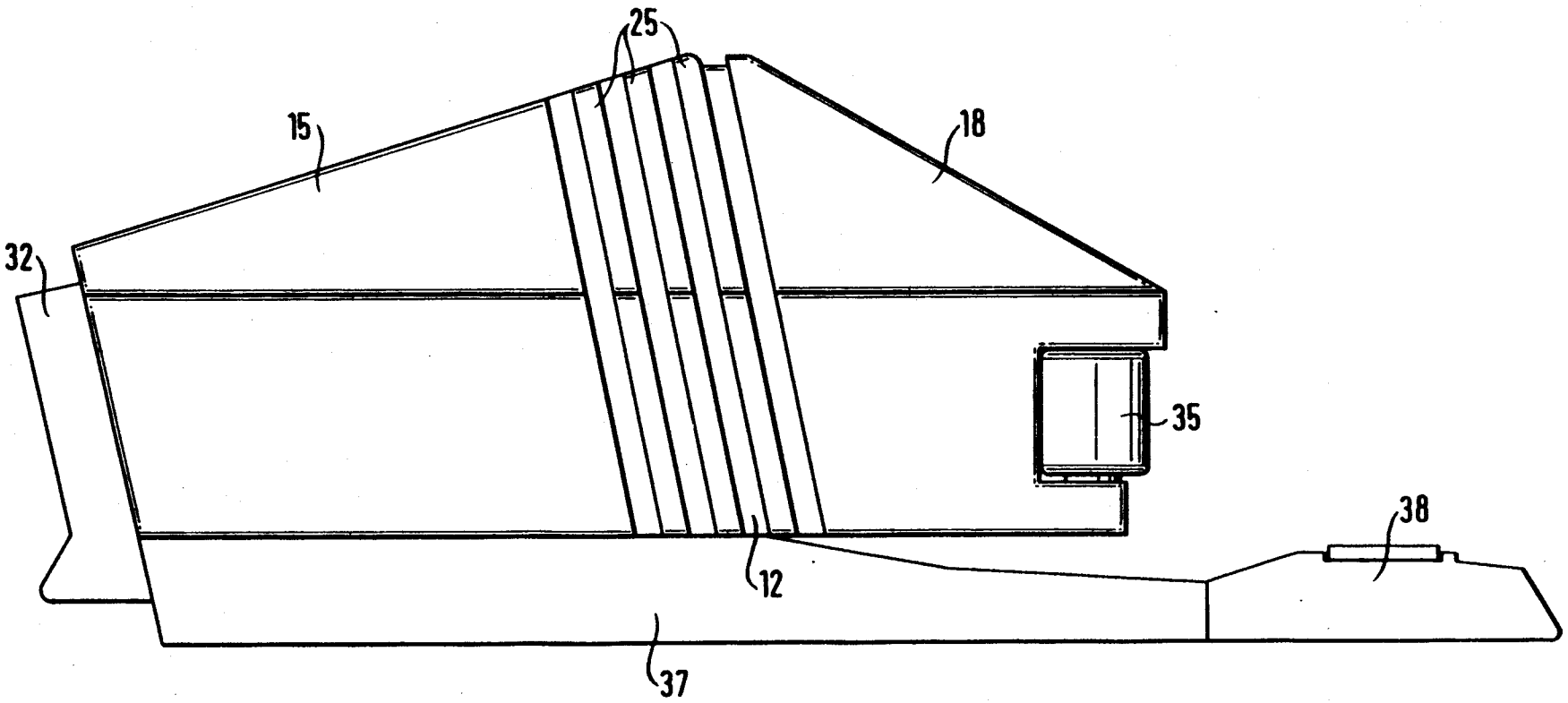
Figure 5:
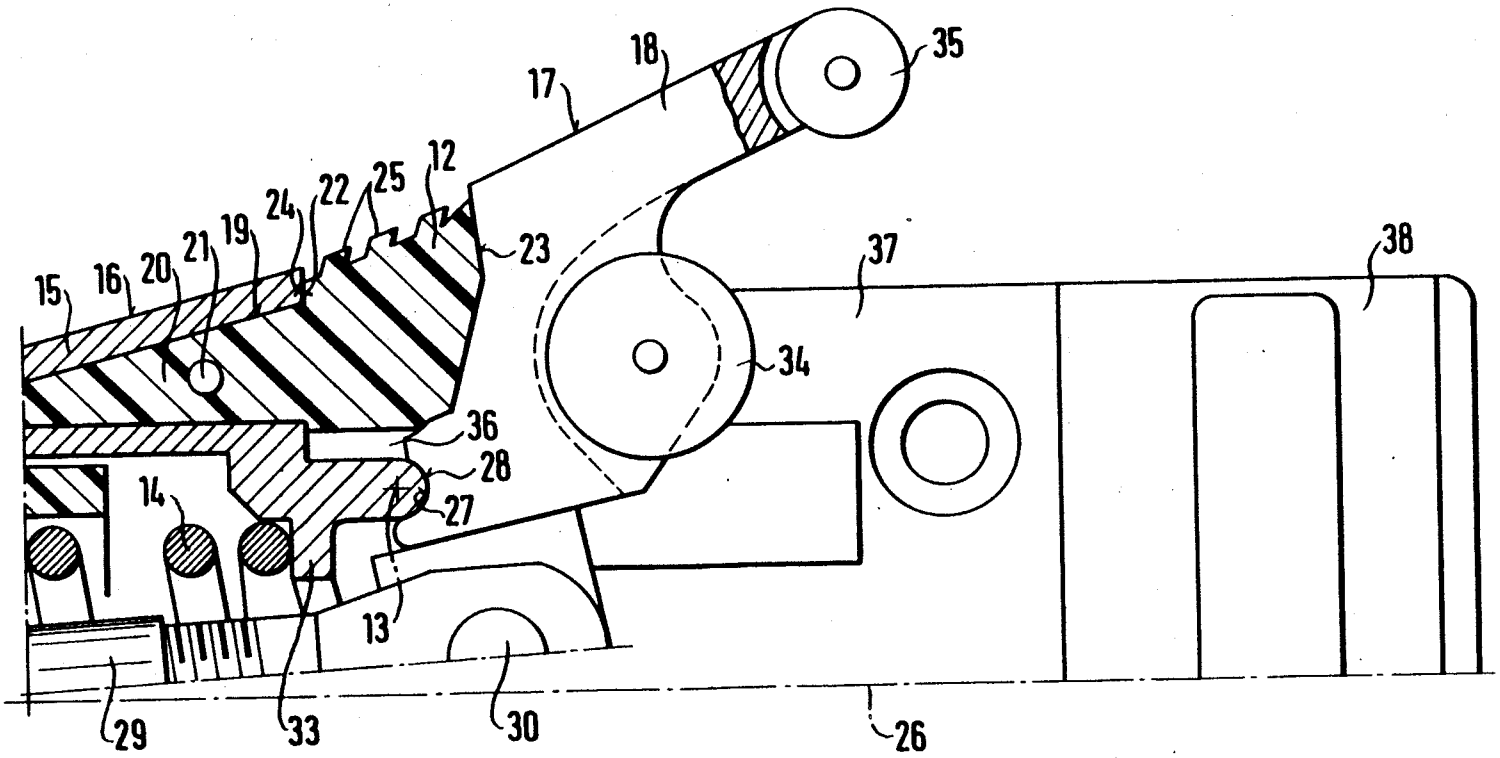

The invention will now be described in the following by way of example and with reference to the drawings and which are shown:

FIG. 1 a partially sectioned plan view of a toe unit formed as a tilting jaw in accordance with the invention, with the filling piece of the invention however only being shown to the right of the vertical central longitudinal plane 26 of the toe unit, FIG. 2 a partially sectioned plan view of a further embodiment of a toe unit in accordance with the invention which corresponds to the arrangement of DE-OS No. 37 20 440.8 apart from the arrangement of the filling piece 12 of the invention, FIG. 3 a partly section side view of the subject of FIG. 2, FIG. 4 a side view of the subject of FIG. 2, and FIG. 5 the section 42 of FIG. 2 with the sole clamp arm 18 pivoted laterally outwardly to the side.

As seen in FIG. 1 substantially vertically extending tilting surfaces 27 are provided at the rear end of a binding housing 15 which can be fixedly mounted to a ski. The tilting surfaces 27 are located to the sides of the vertical central longitudinal plane 26 and spaced therefrom. These tilting surfaces 27 are contacted from the rear by complementary counter tilting surfaces 28 of sole clamp arms 18 which hold a ski boot at the front end at the sides. The two sole clamp arms 18 are hingedly connected together and with a draw rod 29 at the vertical central longitudinal plane 26 via a vertical hinge pin 30.

The draw rod 29 is of two part construction in the illustrated manner, with these two parts being connected together in form locked manner via an inner and outer thread and being longitudinally adjustable relative to one another in the longitudinal direction of the ski.

The draw rod 29 is connected to the release spring 24 in form locked manner via an adjustable screw head 31 and a spring abutment 32 which is connected to the screw head 31 in form locked manner. The release spring is formed as a compression spring and is supported at its other end on a fixed abutment 33 of the housing which has a central opening for the passage of the draw rod 29 therethrough.

On the sole clamp arms 18 there are arranged rollers 34 with a vertical axis of rotation which support a ski boot from the front, and also rollers 35 with a vertical axis of rotation which support the ski boot at the side. The sole clamp arms 18 also engage over the tip or toe of the sole of the boot from the top.

Between the sole clamp arms 18 and the housing 15 there is located a space for movement 11 which can be seen to the left of the central longitudinal plane 26 in FIG. 1 and which is necessary in order to permit the sole clamp arm 18 to execute an outward pivotal movement in the direction of the arrow F. This movement is executed by the sole clamp arm 18 when a laterally excessive force acts on the inserted and non-illustrated ski boot from the side. The sole clamp arm 18 pivots during this movement about a pivotal axis 13 which is defined by the tilting surface 28 and by the tilting countersurface 28, with the draw rod 29 moving rearwardly and causing corresponding compression of the release spring 14.

In accordance with the invention the space for movement 11 shown to the right of the central longitudinal plane 26 in the illustration is filled out between the sole clamp arms 18 and the binding housing 15 by an elastic filling piece 12 which is substantially flush with the outer surfaces 16 and 17 of the housing 15 and of the sole clamp arm 18 at its surfaces which are disposed towards the outer atmosphere.

The filling piece 12 has a substantial spacing 36 at the inside relative to the projection carrying the tilting surface 27.

In the longitudinal direction of the ski the filling piece 12 contacts a support surface 23 of the sole clamp arm 18 and a support surface 24 of the housing 15 which extends generally in the sideways direction and upwardly.

Starting from the support surface 24 a forwardly tapering blind hollow cavity 19 is provided in the housing 15 alongside the release spring 14 at each side of the binding and a forwardly projecting mounting projection 20 of the respective filling piece 12 engages into each of these blind hollow cavities 19. A transverse pin 21 which is for example inserted from the top downwardly through corresponding bores connects the housing 15 and the mounting projection 20 in form locked manner.

The mounting projection 20 merges via a ring shoulder 20 which contacts the support surface 24 into the filling piece 12 which has a larger cross-section.

The filling piece 12, the mounting projection 20 and the blind hollow cavity 19 are only shown at the right-hand side of the central longitudinal plane 26. A corresponding arrangement should be imagined in mirror image form to the left of the central longitudinal plane 26 to fill out the space 11.

The manner of operation of the described toe unit is as follows:

When a lateral release force acts on the right-hand sole clamp arm 18 in the direction of the arrow P, with the release force exceeding a predetermined release value, the sole clamp arm 18 pivots outwardly to the side while elastically compressing the release spring 14 and the filling piece 12 until the ski boot is released. Thereafter the sole clamp arm 18 snaps back again into its normal position illustrated in FIG. 1 under the action of the release spring 14 and of the filling piece 12.

In the embodiment of FIGS. 2 to 5 the same reference numerals are used to designate parts which have counterparts in FIG. 1.

FIGS. 2 to 4 show that the binding housing 15 has a base plate 37 with a toe plate 38 which projects rearwardly behind the sole clamp arms 18, with the base plate 37 and the toe plate 38 being secured by means of screws 39 to the ski 40.

In accordance with FIG. 3 the draw rod 29 is arranged with its axis pointing downwardly to the front relative to the surface of the ski 40 and engages on a peripheral surface 41 of the hinge pin 30 which tapers upwardly in conical manner, as described in detail in German Offenlegungsschrift No.37 20 440.8.

The filling piece 12 and the mounting projection 20 are arranged in accordance with FIGS. 2 and 4 in similar manner to the embodiment of FIG. 1. FIG. 4 makes it clear that in side view the filling piece 12 slopes obliquely downwardly and rearwardly from the top in order to ensure a particularly favourable spring behaviour.

FIG. 5 shows only the right hand half of the toe unit shown in FIG. 2 and indeed only in the section 42 which is surrounded in FIG. 2 by a chain-dotted line. FIG. 5 shows the right-hand sole clamp arm in a position pivoted outwardly to the side in which the filling piece 12 is elastically (resiliently) compressed.

In the embodiment of FIGS. 2 to 5 the filling piece 12 has ribs 25 which project somewhat forwardly and which extend parallel to one another at its side surfaces and its upper surface. The ribs are, as shown in FIG. 2, flush with the outer surfaces 16, 17 of the housing 15 and of the sole clamp arms 18 so that inwardly projecting grooves are present between the ribs 25 with respect to the outer surfaces 16, 17. In this way the spring behaviour of the filling piece 12 is favourably effected.

We claim:

1. A toe unit for a ski safety binding comprising:

a housing fixable to a ski;

a release spring;

sole clamp arms being adapted to locate a tip of an inserted ski boot laterally on the ski;

said clamp arms pivot sideways outwardly against a force exerted by said release spring from a normal position to a release position and release the ski boot upon the ocurrence of sideways forces which lie above a predetermined release value;

a space for movement of said clamp arms defined by and located between the housing and the outwardly pivotable sole clamp arms;

an elastic filling piece filling said space for movement, at least when the sole clamp arms are in the normal position, the elastic filling piece having elasticity, at least along a border of said space with an outside atmosphere;

the elasticity of said filling piece being restricted so that an elastic resetting force at the sole clamp arm generated by the filling piece is a fraction of a resetting force generated by the release spring;

wherein the housing has a blind hollow chamber which extends substantially in the longitudinal direction of the ski relative to the filling piece; a mounting projection arranged on the filling piece engaging into the blind hollow chamber, where said mounting projection is releasably secured to the housing.

2. A toe unit for a ski safety binding comprising:

a housing fixable to a ski;

a release spring;

sole clamp arms which locate a tip of an inserted ski boot laterally on the ski;

said clamp arms being adapted to pivot sideways outwardly against a force exerted by said release spring from a normal position to a release position and release the ski boot upon the occurrence of sideways forces which lie above a predetermined release value;

a space for movement of said clamp arms between the housing and the outwardly pivotable sole clamp arms;

an elastic filling piece filling said space for movement, characterized in that, at least when the sole clamp arms are in the normal position, the elastic filling piece having elasticity, at least along a border of said space with an outside atmosphere;

the elasticity of said filling piece being restricted so that an elastic resetting force at the sole clamp arm generated by the filling piece is a fraction of a resetting force generated by the release spring;

wherein the housing has a blind hollow chamber which extends substantially in the longitudinal direction of the ski relative to the filling piece, with a mounting projection arranged on the filling piece therewith engaging into the blind hollow chamber, where it is releasably secured to the housing (15);

the mounting projection having a substantially smaller cross-section than the filling piece and merging into the filling piece via a step which is provided at least at a top and bottom perimeter of the filling piece.

* * * * *